United States Patent [19]

Dickinson

[11] 4,050,741

[45] Sept. 27, 1977

[54] FEEDING CUT TOBACCO

[75] Inventor: William H. C. Dickinson, Winchester, England

[73] Assignee: W. H. Dickinson Engineering Limited, United Kingdom

[21] Appl. No.: 635,754

[22] Filed: Nov. 28, 1975

[30] Foreign Application Priority Data

Nov. 28, 1974 United Kingdom ..... 51679/74

[51] Int. Cl.[2] ..... B65G 53/24; B65G 53/40

[52] U.S. Cl. ..... 302/13; 131/110; 302/27

[58] Field of Search ..... 302/11–13, 302/27, 28; 198/220 BC, 220 DA; 131/110, 108; 259/72, DIG. 24

[56] References Cited

U.S. PATENT DOCUMENTS

| | | | |
|---|---|---|---|
| 2,827,158 | 3/1958 | Smith | 198/220 BC |
| 2,948,569 | 8/1960 | Bodner | 131/110 |
| 2,983,275 | 5/1961 | Volckers | 131/110 |
| 3,106,427 | 10/1963 | Mortimer | 302/28 |
| 3,277,996 | 10/1966 | Thurston et al. | 198/220 BC |
| 3,319,772 | 5/1967 | Orlandi | 131/110 |
| 3,508,791 | 4/1970 | Mizzau | 131/110 |
| 3,544,167 | 12/1970 | Fuchu et al. | 302/27 |
| 3,650,401 | 3/1972 | Riesbeck et al. | 198/220 BC |

FOREIGN PATENT DOCUMENTS

| | | | |
|---|---|---|---|
| 1,903,577 | 10/1969 | Germany | 302/13 |
| 2,415,677 | 10/1974 | Germany | 302/13 |
| 959,343 | 5/1964 | United Kingdom | 131/110 |
| 1,424,508 | 2/1976 | United Kingdom | 302/27 |

*Primary Examiner*—Evon C. Blunk
*Assistant Examiner*—Jeffrey V. Nase
*Attorney, Agent, or Firm*—Craig & Antonelli

[57] ABSTRACT

Apparatus for distributing tobacco comprises a vibratory conveyor forming a closed loop, means for feeding tobacco onto the vibratory conveyor to form a carpet of tobacco on the vibratory conveyor, and a number of fixed feed pipes extending downwards towards the vibratory conveyor and having tobacco inlet ends positioned near the vibratory conveyor at various positions across the vibratory conveyor, tobacco being sucked up from the vibratory conveyor through the feed pipes, and including on the vibratory conveyor a ramp upstream of each of the feed pipes to lift tobacco towards the feed pipes.

16 Claims, 5 Drawing Figures

FEEDING CUT TOBACCO

This invention is concerned with distributing cut tobacco, for example from one or more storage silos to one or more cigarette making machines.

According to one aspect of this invention, apparatus for distributing tobacco comprises an annular tray which is arranged to receive a carpet of tobacco and to convey the tobacco along a circular path around the axis of the tray, and a number of fixed feed pipes extending downwards towards the tray and having tobacco inlet ends positioned near the tray at various positions across the tray, tobacco being sucked up from the tray through the feed pipes.

Preferably the annular tray is driven with a vibratory motion about its axis to convey the tobacco along its circular path around the tray. The tray preferably has a number of ramps each positioned upstream of one of the feed pipes to lift tobacco towards the respective feed pipe. By this means it is possible to ensure that each feed pipe only sucks up tobacco from a predetermined area of the tray; i.e., the tobacco which moves along a path taking it up the corresponding ramp.

According to another aspect of this invention, apparatus for distributing tobacco comprises a vibratory conveyor forming a closed loop, means for feeding tobacco onto the vibratory conveyor to form a carpet of tobacco on the vibratory conveyor, and a number of fixed feed pipes extending downwards towards the vibratory conveyor and having tobacco inlet ends positioned near the vibratory conveyor at various positions across the vibratory conveyor, tobacco being sucked up from the vibratory conveyor through the feed pipes, and including on the vibratory conveyor a ramp upstream of each of the feed pipes to lift tobacco towards the feed pipes. The vibratory conveyor is preferably an annular tray, but it could in principle alternatively comprises a series of non-circular vibratory conveyors forming a closed loop.

According to another aspect of this invention, a number of closed loop (e.g., circular) vibratory conveyors are each fed from a separate source, and several pneumatic feed pipes are arranged so that each feed pipe can pick up tobacco from any of the vibratory conveyors. For example, with this arrangement the different vibratory conveyors can be supplied with different types or blends of tobacco and each feed pipe can supply a different cigarette making machine. Thus, each cigarette making machine can be supplied with the type or blend of tobacco being supplied to any of the vibratory conveyors by selecting that the pneumatic feed pipe for the cigarette making machine picks up tobacco from the appropriate vibratory conveyor.

It may also be possible to supply a mixture of blends to cigarette making machines using an arrangement such as this. For example it may be possible to supply a given cigarette making machine from more than one of the vibratory conveyors so as to produce at the cigarette making machine a mixture of the blends on the respective vibratory conveyors.

An example of apparatus according to this invention is shown in the accompanying drawings. In these drawings.

Figure 1:
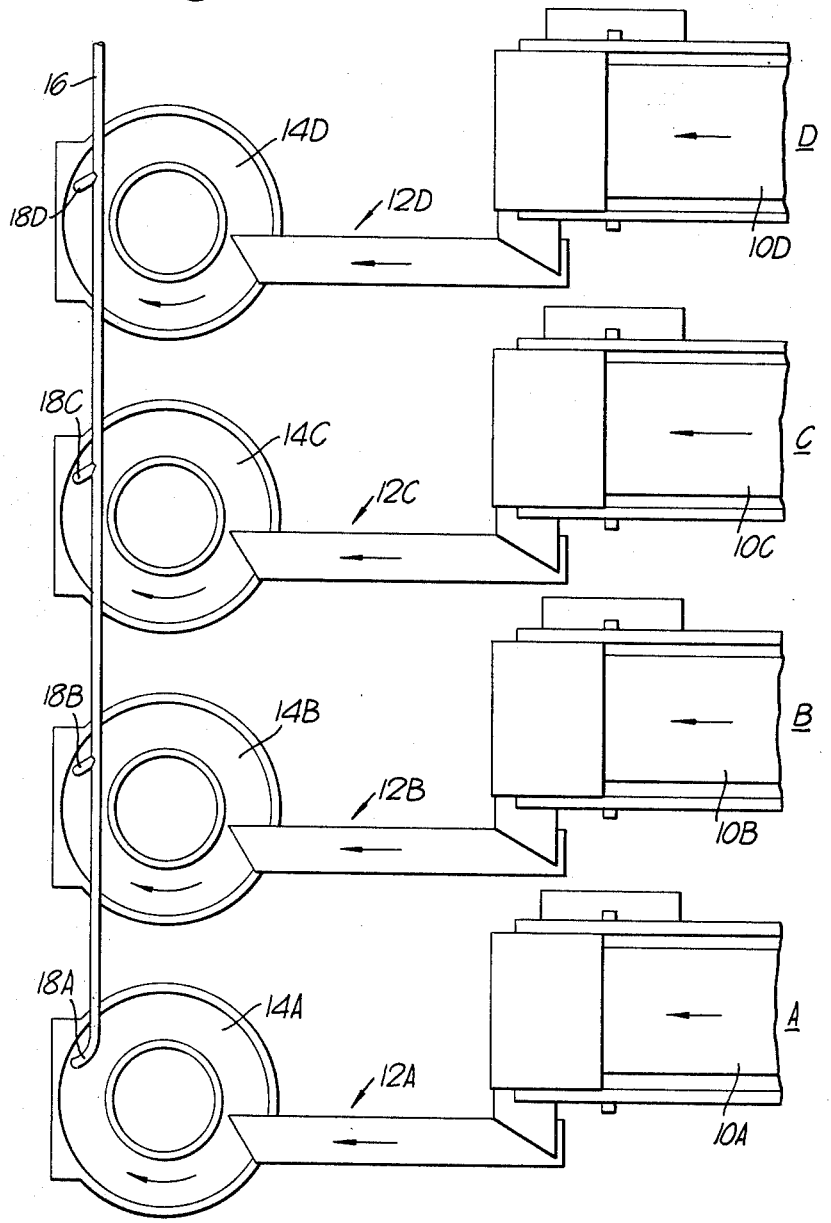
FIG. 1 is a schematic plan view of part of a system for feeding cigarette making machines from a number of storage silos.

FIG. 1 shows a tobacco distributing system including four identical tobacco feeding units A, B, C and D. The parts of the units will be described generally using basically the same reference numerals. In FIG. 1 these reference numerals are used with the addition of a letter suffix corresponding to the reference letter of the unit of which they form a part.

Each unit has a storage silo 10 of known form. A linearly vibrating tray 12 feeds cut tobacco from the silo 10 to a vibratory conveyor in the form of an annular tray 14; the tray 12 extends approximately radially towards the annular tray 14 and has an oblique downstream edge 13 so that it delivers tobacco across the entire width of the tray 14. A pneumatic feed pipe 16 is arranged to feed cut tobacco to a cigarette making machine (not shown). The feed pipe 16 has a number of branches forming feed or pick-up pipes 18A to D which are arranged to pick up tobacco from the corresponding tray 14. It will be understood that although, for the sake of clarity, only one feed pipe 16 is shown in FIG. 1, there would in fact be several pneumatic feed pipes, one for each cigarette making machine being fed from the system. Each cigarette making machine may include, for example, a tobacco-receiving arrangement such as that shown in British Patent specification No. 1,192,177 or No. 1,396,273.

It will be further appreciated, that although four units, A, B, C and D are shown in FIG. 1, there could be more or less units than this, depending on the number of blends being supplied. Each silo 10 may contain a different blend of tobacco.

There would be a sufficient number of pick-up pipes 18 associated with each of the pneumatic feed pipes 16 to the cigarette making machines to be able to pick up tobacco from the tray 14 of any one of the units or possibly from two or more units simultaneously.

Figure 2:
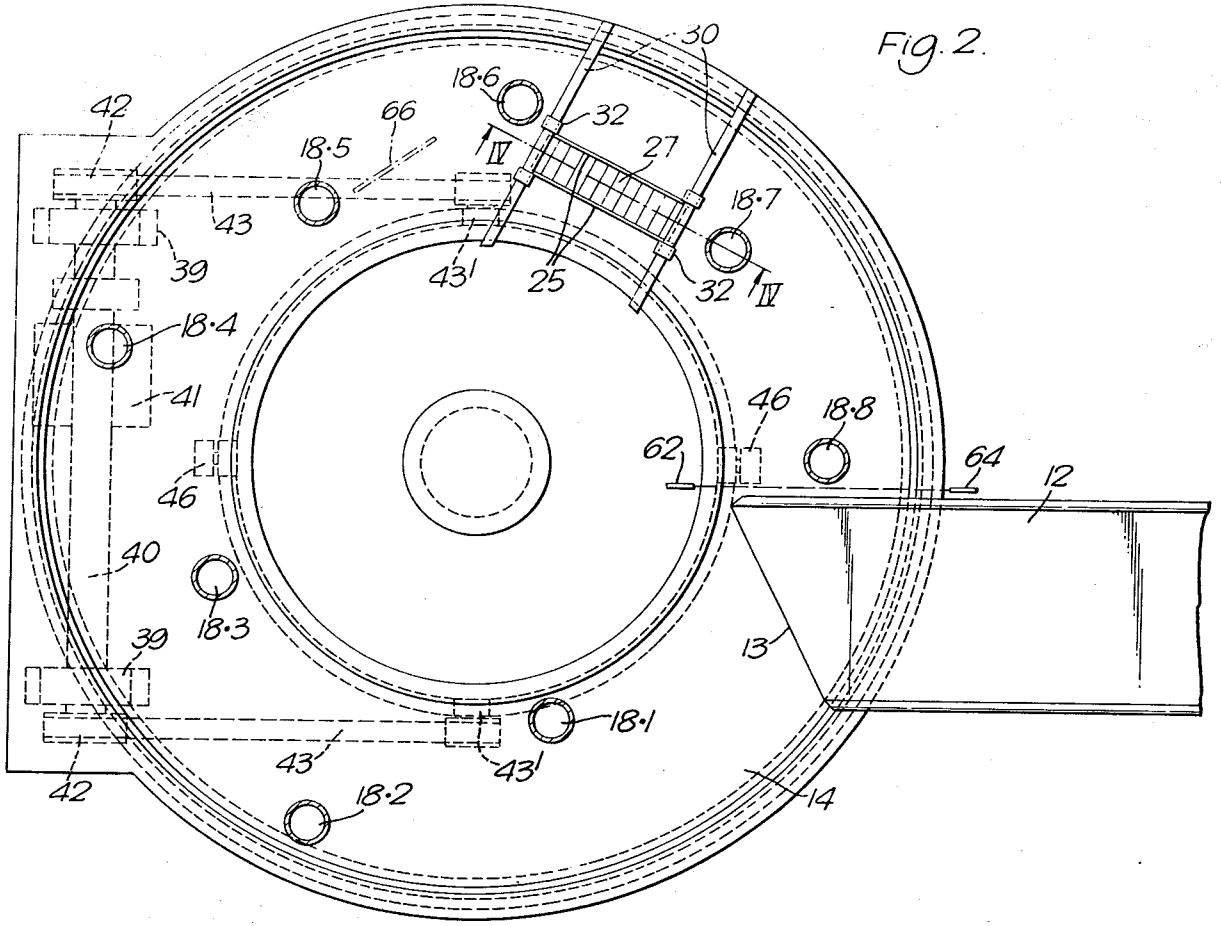
FIG. 2 is a plan view of one of the vibratory conveyors of FIG. 1.

FIG. 2 shows a vibratory tray 14 having a vibratory feed conveyor 12 associated with it. FIG. 2 shows by way of example eight pick-up pipes, at various different distances from the centre of the tray, which are respectively referenced 18.1, 18.2, 18.3, 18.4, 18.5, 18.6, 18.7 and 18.8, arranged to pick up tobacco from the tray 14. The pick-up pipes will be referred to generally by the reference 18.

The pick-up pipes 18 are preferably arranged so that when they pick up tobacco from the tray 14, they completely remove the layer of tobacco on the tray immediately underneath the pipe. The tray is thus sucked clean at that point, and this tends to avoid a gradual accumulation of short pieces of tobacco at the bottom of the tray. As a result of the vibration of the tray 14, small pieces of tobacco will tend to settle on the bottom of the tray 14. If the pick-up pipes 18 do not pick up a stripe of tobacco which leaves the tray clean, these small pieces of tobacco will gradually accumulate on the bottom of the tray.

In order to present the tobacco to the pick-up pipes 18 more positively, ramps are provided beneath each down pipe to lift the tobacco up to the pipe. The ramps are shown in FIGS. 4 and 5; for the sake of clarity they are not shown in the other figures, except that one is shown in FIG. 2.

Figure 5:
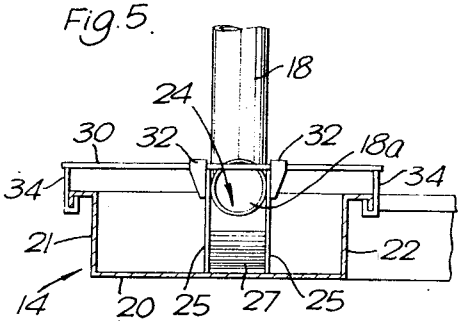
FIG. 5 is an end view of the ramp shown in FIG. 4, from the left of FIG. 4.
Figure 4:
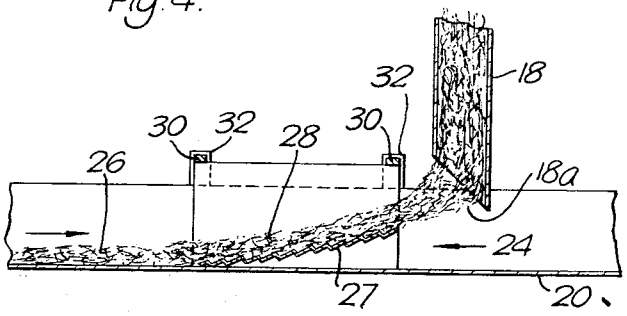
FIG. 4 is a section on the line IV—IV in FIG. 2 showing the ramp.

FIGS. 4 and 5 show the tray 14, with a bottom 20 and sides 21 and 22. A ramp 24 is positioned in the tray 14 to lift tobacco 28 up out of the general mass of tobacco 26 in the tray and present it to the pipe 18. The ramp 24 has a serrated, somewhat step-like floor 27 to assist the flow of tobacco up the ramp. When the pipe 18 is not sucking tobacco from the tray, the tobacco 28 drops off the upper (right-hand) end of the ramp 24 back into the general mass of tobacco 26.

The ramp is mounted so that its position in the tray can be adjusted. This allows each ramp 24 to be positioned accurately under the relevant pick-up pipe 18. One way of mounting the ramp 24 is shown schematically in FIGS. 4 and 5. The ramp is held in position on a radially extending support bar 30 by means of clamps 32 attached to side walls 25 of the ramp 24 which extend upwards from the ramp and prevent tobacco falling off the sides of the ramp. Thus the ramp 24 can be fixed on the tray 14 at any appropriate distance from the centre of the tray. The support bars 30 are in turn held in their circumferential position on the tray 14 by means of clamping members 34 attached to the ends of the bars 30 and arranged to engage lips at the tops of the sides 21 and 22 of the tray. The bars 30 may thus be fixed in any circumferential position on the tray.

The ramps are mounted so that the pick-up pipe 18 is adjacent to the top end of the ramp 24 as shown in FIG. 4. The pick-up pipe 18 preferably has an inclined end 18*a* as in FIG. 4.

As an idea of scale, the tray 14 may be about 6 inches deep; i.e., the sides 21 and 22 may be about 6 inches high. The depth of the mass of tobacco 26 on the tray may be about 1.4 inches. The maximum height of the ramp 24 may be about 3 inches and the angle of the ramp 24 may be about 10°. The width of the tray 14 (i.e., the width of the bottom 20) may be about 18 inches and the overall diameter of the tray may be about 80 inches. A tray of this size is capable of handling about 5,000 pounds of tobacco per hour. The tray could be wider if a larger flow rate were required.

Figure 3:
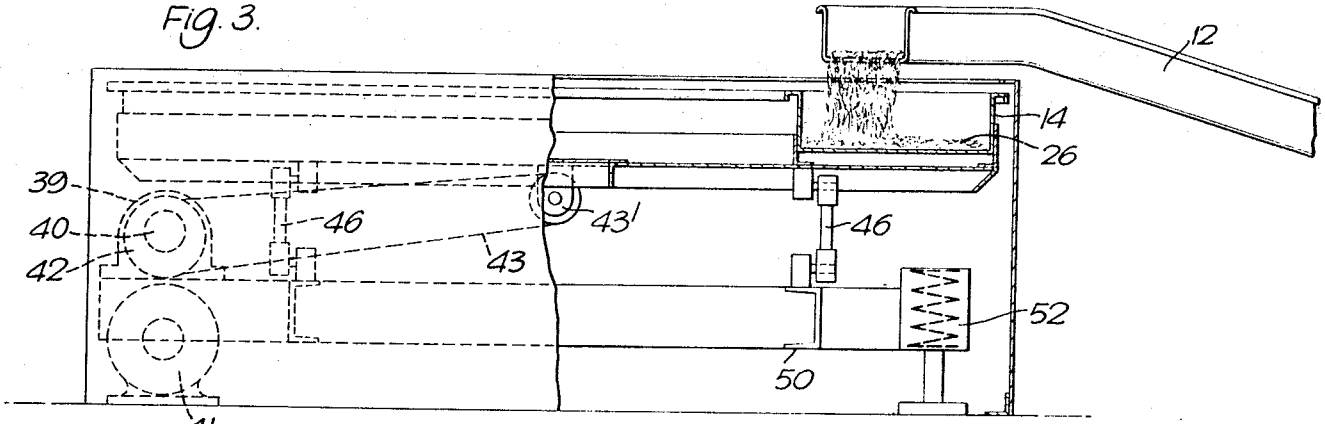
FIG. 3 is a part-sectional elevation of the vibratory conveyor of FIG. 2.

The tray 14 is driven so as to vibrate substantially rotationally about its axis. One way of doing this is illustrated in FIGS. 2 and 3. A shaft 40 mounted in bearings 39 is driven from an electric motor 41 (e.g., by a belt drive). Each end of the shaft 40 carries an eccentric 42 on which one end of a connecting rod 43 is pivotally attached; and the other end of each connecting rod is pivoted to a bracket 43 on the tray. Thus each eccentric, during rotation, moves the associated side of the tray cyclically towards and away from the shaft 40, e.g., through a distance of about 1 inch. The two eccentrics 42 are mounted on the shaft 180° out of phase. Thus rotation of the shaft 40 causes the tray 14 to be oscillated with a circular motion.

As can be seen from FIG. 3, the tray 14 is supported by a number of pivoted links 46 equally spaced circumferentially around the tray 14. The bottom ends of the links 46 are carried by a chassis 50 which also carries the drive arrangement. The chassis 50 is carried on anti-vibration mountings 52. Each link 46, seen in a radial direction (towards the centre of the tray), is inclined to the vertical in a direction such that the tray is lifted slightly during each rotational movement in a clockwise direction to produce a clockwise motion of tobacco around the tray.

As an alternative, the tray may be vibrated rotationally by means of only one connecting rod.

It will be seen from FIG. 2 that the down pipes 18 etc. are mounted over the tray 14 at different radial distances. Thus pipe 18.3 is a little further out from the centre of the tray 14 than is pipe 18.1 and it is not so far out as pipe 18.5. The pipes are randomly positioned from the centre of the tray to provide room for each ramp upstream of the corresponding pipe.

The supply of tobacco to the tray 14 is controlled in response to the amount of tobacco remaining on the tray after the pick-up pipe 18.8 in FIG. 2. A beam of light from a lamp 62 is directed across the tray 14 towards a photocell 64. A supply of tobacco to the tray 14 is maintained as long as the photocell 64 is unobscured. If the photocell is obscured, this indicates that there is a sufficient depth of tobacco remaining on the tray 14 and the supply of tobacco to the tray 14 is stopped until the level on the tray 14 drops. The tray 12 may, when it is operating, deliver tobacco at a rate about 20% greater than the average rate at which tobacco is sucked off the tray 14.

The control circuitry connected to the photocell 64 preferably incorporates an averaging effect so that the feed to the tray 14 is not started up or shut down for short periods of time as a result of small hollows or humps in the flow of tobacco on the tray 14. For example, the circuit would disregard signals from the photocell 64 which were of less than a predetermined minimum duration.

Referring again to FIG. 1, each of the silos 10 may be supplied with a different blend of tobacco. Each pick-up pipe 18 incorporates a valve. Thus if, for example, it is desired to feed the cigarette making machine to which pipe 16 leads with the blend of tobacco in the silo 10B, the valves in pipes 18A, 18C and 18D are closed and the valve in pipe 18B left open. Selection of the appropriate valve combination thus allows any of the cigarette making machines to receive the blend of tobacco in any one of the silos 10.

As shown in FIG. 5, the bottom 20 of the tray 14 is flat and horizontal. Alternatively, it could be slightly inclined (e.g., by about 3°) so as to rise towards the outer circumference of the tray; by this means the natural tendency of the tobacco to move slowly outwards can be at least partially countered.

The tray 14 may be fitted with a number of deflector or spreader vanes whereby tobacco which passes a temporarily inoperate pick-up pipe is deflected at least partly into a path leading to another pick-up pipe; this is to avoid a pronounced build-up of tobacco in any particular area on account of the associated pick-up pipe being inoperative. For example, there may be a deflector after each pipe which deflects part of the tobacco outwards (or inwards); one such deflector between pick-up pipes 18.5 and 18.6 is shown at 66. Downstream of the pipe 18.2 there may be a deflector vane which deflects or spreads any remaining tobacco inwards. It will be understood that the vibratory action of the tray 14 also tends to spread out the tobacco.

It should be understood that the ramps are positioned so that their upstream ends (which receive the tobacco) cover different areas across the width of the tray. The ramp leading to the pipe 18.1 cannot, however, cover the area of the tray adjacent to the inner wall of the tray. Instead, that area is covered by the ramp leading to the pipe 18.5; i.e., the ramp leading to the pipe 18.5 is inclined to a radial line so that its upstream end is adjacent to the wall. The next area is covered by the ramp leading to the pipe 18.3, and the next area (under the pipe 18.5) is covered by the ramp leading to the pipe 18.1. The ramps leading to the pipes 18.8, 18.6, 18.4 and 18.2 are each inclined to a tray radius at the respective pipe by substantially the same angle as the ramp leading to the pipe 18.7, as shown in FIG. 2.

I claim:

1. Apparatus for distributing tobacco, comprising a vibratory conveyor forming a closed loop, means for feeding tobacco onto the vibratory conveyor to form a carpet of tobacco on the vibratory conveyor, and a number of fixed feed pipes extending downwards towards the vibratory conveyor and having tobacco inlet ends positioned near the vibratory conveyor at various positions across the vibratory conveyor, tobacco being sucked up from the vibratory conveyor through the feed pipes, and including on the vibratory conveyor a ramp upstream of each of the feed pipes to lift tobacco towards the feed pipes.

2. Apparatus according to claim 1 including at least one deflector member on the vibratory conveyor whereby tobacco which passes an inoperative feed pipe is at least partly deflected sideways into a path below another feed pipe.

3. Apparatus for distributing tobacco, comprising an annular tray which is arranged to receive a carpet of tobacco and is driven with a vibratory motion about its axis to convey the tobacco along a circular path around the axis of the tray, and a number of fixed feed pipes extending downwards towards the tray and having tobacco inlet ends positioned near the tray at various positions across the tray, tobacco being sucked up from the tray through the feed pipes, the tray having a number of ramps each positioned upstream of one of the feed pipes to lift tobacco towards the respective feed pipe.

4. Apparatus according to claim 3 in which each ramp comprising a separate part which is adjustable in its position on the tray.

5. Apparatus according to claim 3 in which the upper surface of each ramp is serrated in a step-like manner to assist movement of tobacco up the ramp.

6. Apparatus according to claim 3 in which each ramp has side walls to prevent tobacco on the ramp from falling off sideways.

7. Apparatus for distributing tobacco, comprising an annular tray which is arranged to receive a carpet of tobacco and is driven with a vibratory motion about its axis to convey the tobacco along a circular path around the axis of the tray, and a number of fixed feed pipes extending downwards towards the tray and having tobacco inlet ends positioned near the tray at various positions across the tray, tobacco being sucked up from the tray through the feed pipes, and including deflector members on the tray whereby tobacco which passes an inoperative feed pipe is at least partly deflected sideways into a path below another feed pipe.

8. A tobacco feed system including a number of pipes for delivering tobacco to different cigarette making machines, each pipe having a number of branches forming feed pipes for sucking tobacco from any one of a number of tobacco distributing apparatus each comprising an annular tray which is arranged to receive a carpet of tobacco and to convey the tobacco along a circular path around the axis of the tray, a number of fixed feed pipes extending downwards towards the tray and having tobacco inlet ends positioned near the tray at various positions across the tray, tobacco being sucked up from the tray through the feed pipes and separator means for substantially separating the part of the tobacco carpet which passes beneath each inlet end from adjacent parts of the carpet for application to the respective feed pipe.

9. Apparatus for distributing tobacco, comprising an annular tray, means for delivering tobacco onto the annular tray as a carpet spread across a radius of the tray, means for driving the tray to convey the tobacco along a circular path around the tray, a number of fixed feed pipes extending downwards towards the tray and having tobacco inlet ends positioned near the tray at various distances from the axis of the tray, tobacco being sucked up from the tray through the feed pipe, and separator means for substantially separating the part of the tobacco carpet which passes beneath each inlet end from adjacent parts of the carpet for application to the respective feed pipe.

10. Apparatus according to claim 9 in which the annular tray is driven with a vibratory motion about its axis to convey the tobacco along its circular path around the tray.

11. Apparatus according to claim 10 in which the tray is mounted on a number of circumferentially spaced, upwardly extending links inclined slightly from the vertical so that rotatary vibration of the tray about its axis causes tobacco on the tray to move in a predetermined direction.

12. Apparatus according to claim 11 in which the rotary vibration of the tray is produced by two connecting rods which are connected to opposite sides of the tray and are driven respectively by eccentrics 180° out of phase of one another.

13. Apparatus according to claim 10 including a photoelectric device for detecting the height of the tobacco on the annular tray at a position just upstream of the position at which tobacco is delivered onto the annular tray and for controlling the delivery of tobacco onto the annular tray.

14. Apparatus according to claim 9 in which the feed pipes are spread circumferentially about the axis of the annular tray.

15. Apparatus according to claim 9 in which the means for delivering tobacco onto the tray comprises conveyor means for conveying a carpet of tobacco onto the tray at a predetermined location about the axis of the tray.

16. Apparatus according to claim 15 in which the tobacco is delivered onto the annular tray by a linearly vibrating tray which extends approximately radially towards the annular tray and has a downstream edge so positioned as to deliver tobacco across substantially the entire width of the annular tray.

* * * * *